US011850612B2

(12) United States Patent
Kenny

(10) Patent No.: US 11,850,612 B2
(45) Date of Patent: Dec. 26, 2023

(54) RIGID BOTTLE WITH PRESSURE EQUALIZATION FOR USE IN A LIQUID DISPENSING SYSTEM

(71) Applicant: Aereos Interior Solutions, LLC, Euless, TX (US)

(72) Inventor: Paul Kenny, Thousand Oaks, CA (US)

(73) Assignee: Aereos Interior Solutions, LLC, Euless, TX (US)

( * ) Notice: Subject to any disclaimer, the term of this patent is extended or adjusted under 35 U.S.C. 154(b) by 268 days.

(21) Appl. No.: 17/469,521

(22) Filed: Sep. 8, 2021

(65) Prior Publication Data

US 2022/0080439 A1 Mar. 17, 2022

Related U.S. Application Data

(60) Provisional application No. 63/078,525, filed on Sep. 15, 2020.

(51) Int. Cl.
*B05B 11/00* (2023.01)
*A47K 5/12* (2006.01)

(52) U.S. Cl.
CPC ..... *B05B 11/00442* (2018.08); *A47K 5/12* (2013.01)

(58) Field of Classification Search
CPC ..... B05B 11/00442; A47K 5/12
See application file for complete search history.

(56) References Cited

U.S. PATENT DOCUMENTS

| | | | | |
|---|---|---|---|---|
| 4,317,467 | A | 3/1982 | Heyland | |
| 4,922,954 | A | 5/1990 | Blomquist et al. | |
| 5,249,598 | A | 10/1993 | Schmidt | |
| 5,499,654 | A | 3/1996 | Shefte | |
| 6,015,444 | A | 1/2000 | Craft et al. | |
| 6,447,565 | B1 | 9/2002 | Raszkowski et al. | |
| 7,044,150 | B2 | 5/2006 | Seidl | |
| 8,105,408 | B2 | 1/2012 | Thomas et al. | |
| 11,661,965 | B2 * | 5/2023 | Elsaadani | F16B 35/06 174/547 |
| 11,692,644 | B2 * | 7/2023 | Sanders | F16K 47/08 137/513.7 |
| 2005/0227610 | A1 * | 10/2005 | Zukor | H05K 5/0216 454/339 |
| 2019/0135505 | A1 | 5/2019 | Cain | |
| 2020/0000292 | A1 * | 1/2020 | Krishnan | A47K 5/12 |
| 2022/0127128 | A1 * | 4/2022 | Leeds | B67D 1/0005 |

* cited by examiner

*Primary Examiner* — Jeremy Carroll
(74) *Attorney, Agent, or Firm* — CROWE & DUNLEVY

(57) ABSTRACT

A liquid dispensing system includes a liquid container and a one way user-actuated dispensing valve for dispensing contained liquid. The liquid container further includes a two way vent which allows for ventilation of the contained liquid/gas in response to changes in air pressure outside of the liquid container.

20 Claims, 3 Drawing Sheets

RIGID BOTTLE WITH PRESSURE EQUALIZATION FOR USE IN A LIQUID DISPENSING SYSTEM

CROSS REFERENCE TO RELATED APPLICATIONS

This application claims priority from U.S. Provisional Application for Patent No. 63/078,525, filed Sep. 15, 2020, the disclosure of which is incorporated by reference.

TECHNICAL FIELD

Modes of implementation and embodiments relate to a liquid dispensing system, for example of the type used to dispense hand sanitizer, and, in particular, to a rigid bottle for use in such a liquid dispensing system.

BACKGROUND

A liquid dispensing system used to dispense hand sanitizer is now a commonplace article. Such dispensers are, for example, employed in washrooms, toilets, kitchens, hospitals, surgeries, hair/beauty salons, workshops and factories. In many cases, such dispensers are mounted to a wall, often in the vicinity of a basin, bath, shower or toilet bowl; alternatively, such dispensers may be freestanding. The liquid to be dispensed is contained within a container. The liquid container may be of the rigid type (such as with a tank) or of the collapsible type (such as with a bag). The container is connected through a suitable fitting to a one-way dispensing valve that may be actuated by a user to cause the release of a desired amount of liquid through a nozzle. In use, the valve is typically operated by hand, arm or elbow. In many applications, this liquid is dispensed into the user's hand, or onto a carrier such as a cloth, after which the dispensed liquid is rubbed onto the skin, or is applied from said carrier onto a surface to be treated, such as a metal or ceramic surface to be cleaned, for example.

As concerns with sanitization grow in the COVID-19 era, there is a need to install such liquid dispensing systems within the passenger cabin of commercial aircraft. This presents a safety concern. Because of pressurization and depressurization of the aircraft during takeoff and landing, it is impossible to use a standard off-the-shelf liquid dispensing system. The liquid container, of either the collapsible bag or rigid bottle type, is not designed to handle pressurization and depressurization of the aircraft without expansion and contraction issues. Over pressurization in a heated aircraft could cause a flammable liquid hand sanitizer material to explode and contraction of the container could cause the liquid to be forced through the one way valve and out of the nozzle creating a flammable spill on the aircraft floor.

SUMMARY

In an embodiment, a liquid container for use in a liquid dispensing system is configured with a fitting for connection to a one way valve through which the contained liquid is controllably dispensed by a user and further includes a two way vent which allows for ventilation of the contained liquid/gas in response to changes in air pressure outside of the liquid container.

The two way vent is designed with porous vapor pathway which supports pressure equalization (venting) while simultaneously impeding liquid loss (filtering).

The liquid container, and associated liquid dispensing system, is particularly useful in connection with installations within the cabin of a commercial aircraft. The porosity of the two way vent enables pressure equalization between the inside and outside of container as the aircraft undergoes pressurization changes during flight. The porosity, however, inhibits unwanted liquid discharge in response to aircraft turbulence and or rapid descent. The equalization of pressure through the two way vent addresses concerns with possible pressure build-up within the container that could lead to an explosion of the flammable sanitizing solution.

BRIEF DESCRIPTION OF THE DRAWINGS

Other advantages and features of the invention will become apparent on examining the detailed description of completely non-limiting modes of implementation and embodiments and the appended drawings, in which.

DETAILED DESCRIPTION

Figure 1:
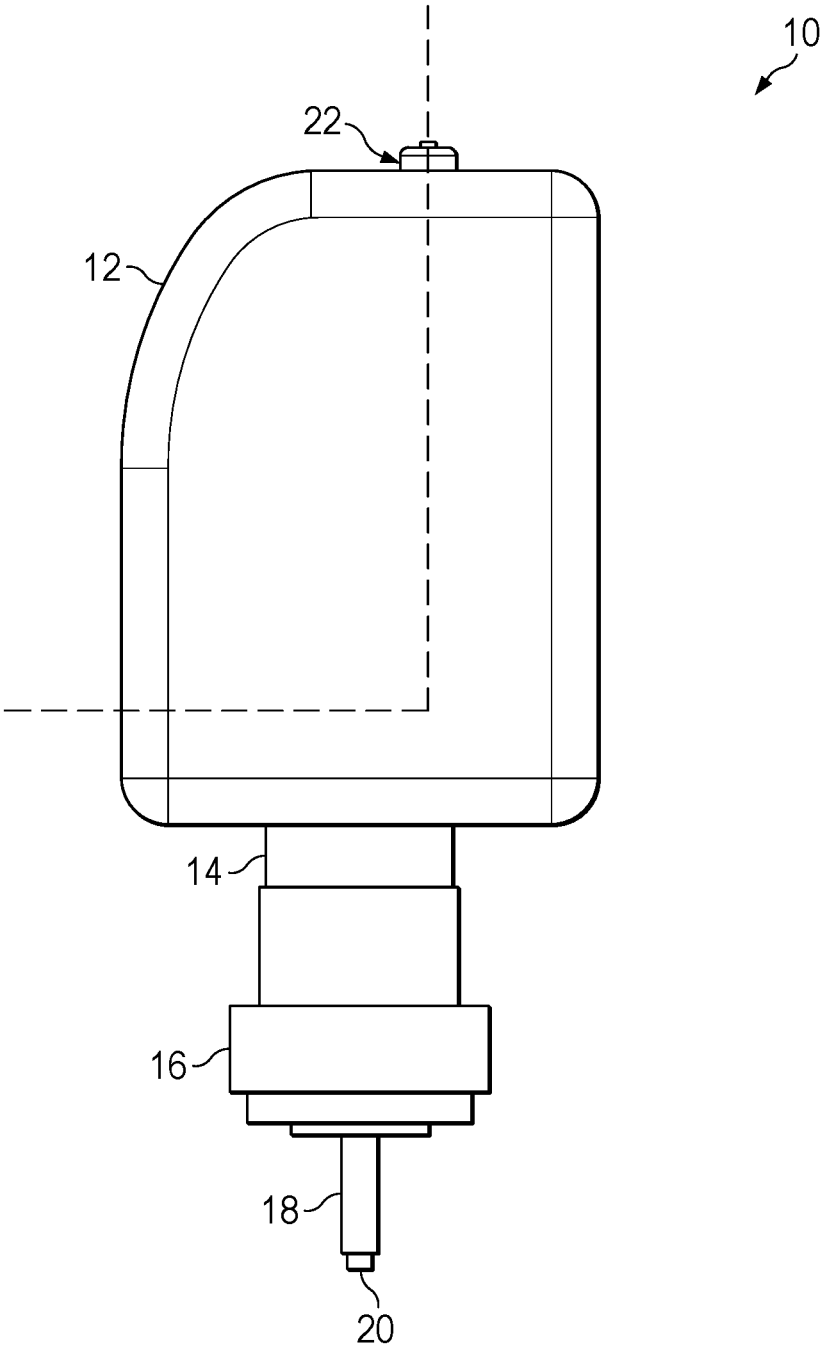
FIG. 1 is side view of a liquid dispensing system.
Figure 2:
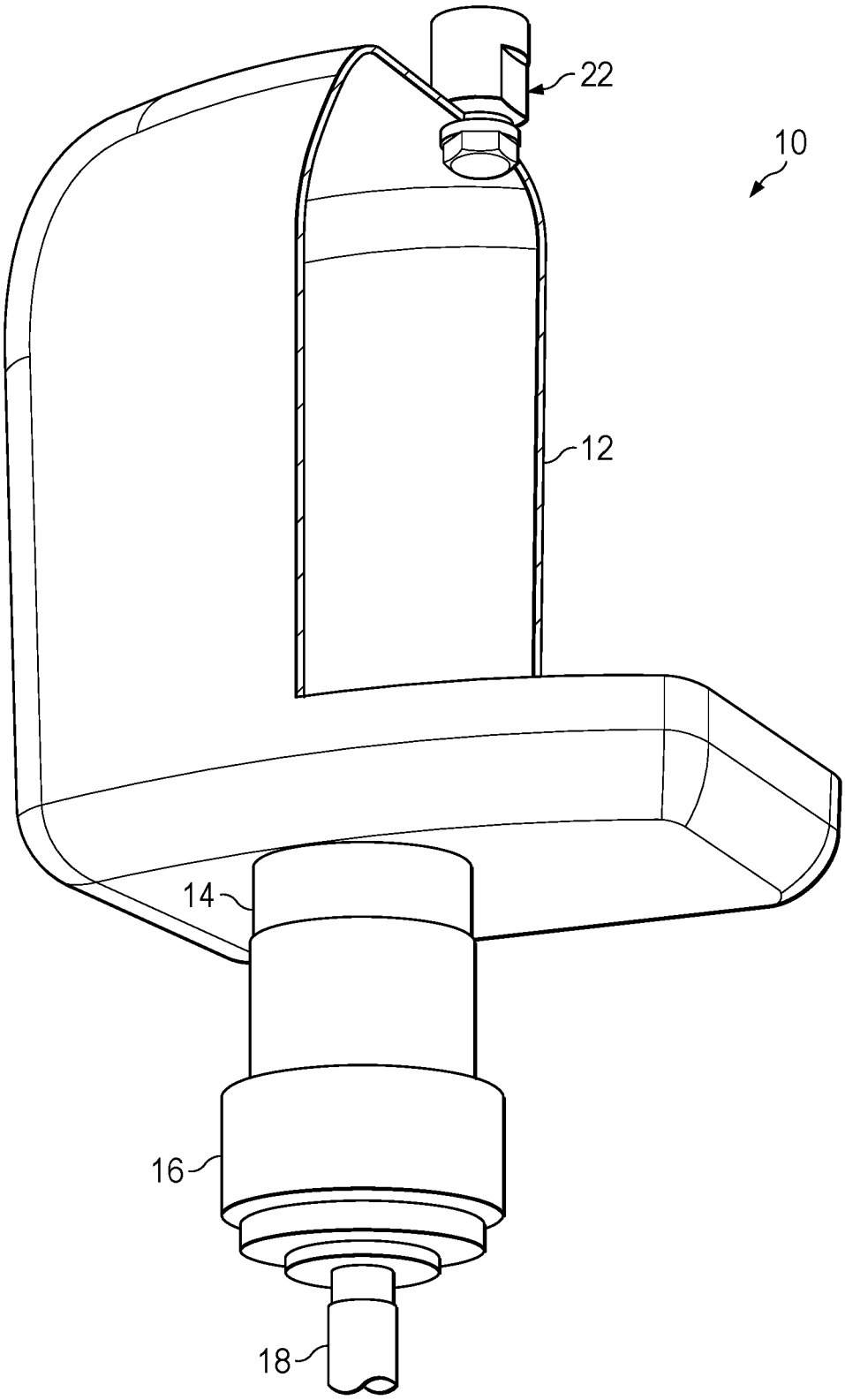
FIG. 2 is a perspective view, with a cutaway, of the liquid dispensing system.

Reference is now made to FIG. 1 which shows a side view of a liquid dispensing system 10 and FIG. 2 which is a perspective view, with a cutaway, of the liquid dispensing system 10. The system 10 includes a rigid container body 12 including a fitting 14 for making a connection to a dispensing valve 16. The dispensing valve 16 is a conventional one way valve that is actuated through a lever 18 to dispense liquid from the container 12 through a nozzle 20. A two way vent 22 is mounted to the container body 12 of the system 10 (preferably at or near the top of the container body considering its normal orientation when installed in the dispenser of the dispensing system). This two way vent 22 supports equalization of pressure between the interior and exterior of the container body 12 during use of the system. This is important in situations where the system 10 is installed in an environment subject to significant pressure swings. An example of this is would be an installation within the cabin of a commercial aircraft.

The two-way vent 22 comprises a stainless-steel body surrounding porous stainless-steel particles. The porous stainless-steel particles function to prevent the escape of liquid during turbulence and rapid descent of the aircraft that could result in damage to aircraft side walls and internal structure. However, those particles further allow vapor to vent in both directions preventing the buildup of gasses that could cause combustion.

Figure 3A:
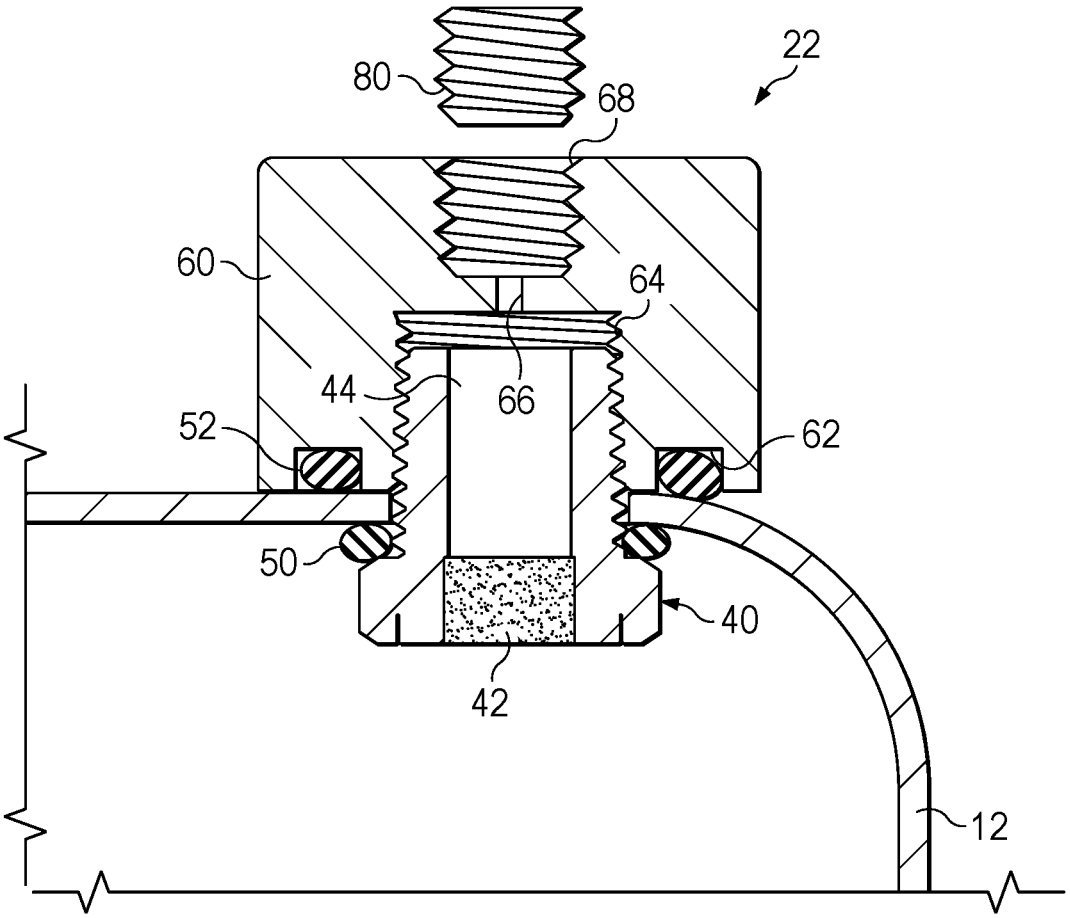
FIGS. 3A-3B illustrate an embodiment of the two-way vent used by the liquid dispensing system.
Figure 3B:
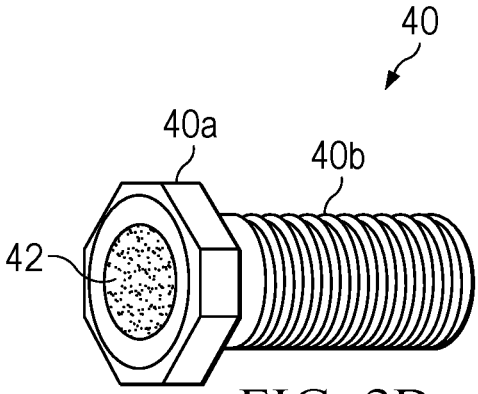

Reference is now made to FIGS. 3A-3B will illustrate an embodiment of the vent 22. The vent 22 is configured with a stainless-steel body 40 in the general shape of a hex-bolt with a hex head 40*a* and a threaded shaft 40*b*. A central bore extends axially through the hex head and threaded shaft. A portion of the central bore, generally located in the area of the hex head 40*a*, is filled by a region 42 of porous stainless-steel particles. As an example, the porous stainless-steel particles may be implemented as a sintered stainless steel material. The remaining portion of the central bore, generally located in the area of the threaded shaft 40*b*, forms a chamber 44.

The central bore partially filled with the region 42 of porous stainless-steel particles forms a venting path that permits vapor flow between the interior and exterior of the container 12 in support of pressure equalization during a pressure change event. The region 42 of porous stainless-steel particles further functions to impede liquid flow, and the chamber 44 acts as a reservoir to contain liquid which may unwantingly pass through the region 42 of porous stainless-steel particles and further assist in draining of that liquid back into the container following the pressure change event.

The wall of the container body 12 includes an opening through which the threaded shaft 40*b* of the stainless-steel body 40 passes. An o-ring 50 is provided to form a liquid seal between a back side of the hex head 40*a* and the inner surface of the container body 12 around the opening. The opening in the wall of the container body 12 may, in an embodiment, be threaded in order to threadingly engage with the threaded shaft 40*b* when installing and securing the vent 22.

As further, or alternative, means for installing and securing the stainless-steel body 40 of the vent 20 to the opening in the container body 12, a cap 60 may be used in connection with o-ring 52 (constrained within an annular channel 62 at a back side of the cap) to form a liquid seal between the back side of the cap 60 and the outer surface of the container body 12 around the opening. The backside of the cap 60 includes a threaded opening 64 that can threadingly engage with the threaded shaft 40*b* when installing and securing the vent 22. The cap 60 may, for example, be made of a plastic or other synthetic material (such as an acetal material).

The cap 60 may include a central bore of varying size and configuration which extends from the back side to the front side. A first portion of the central bore has a first diameter and is threaded to form the threaded opening 64 for threaded engagement with the threaded shaft 40*b*. A second portion of the central bore has a second diameter (much smaller than the first diameter) that forms a pressure differential compensating orifice 66. This orifice supports pressure equalization but can also act as a constraint against unwanted liquid flow. A third portion of the central bore has a third diameter (larger than the second diameter and smaller than the third diameter) and is threaded to form a threaded opening 68 at the front side of the cap 60. The threaded opening 68 is configured to threadingly engage with a threaded plug 80 that may be inserted and secured therein to close off the central bore. This is advantageous as this permits sealing of the vent 22 to preclude equalization of and/or leaking from the container body 12 during conventional shipping or transport activities. The threaded plug 80 is then removed when the container is installed and configured for use on, for example, the commercial aircraft.

The invention claimed is:

1. A liquid container for use in a liquid dispensing system, comprising:

a container body;

a fitting for the container body that is configured for connection to a one way valve through which a contained liquid may be controllably dispensed by a user; and a two way vent mounted to the container body which allows for ventilation of the contained liquid/gas in response to changes in air pressure outside of the liquid container;

wherein the two way vent comprises a stainless-steel body surrounding porous stainless-steel particles;

wherein the stainless steel body includes a head portion and a shaft portion with a central bore, wherein a first portion of the central bore is filled with said porous stainless-steel particles and wherein a second portion of the central bore is open to form a pressure differential compensating chamber; and wherein the pressure differential compensating chamber provides a reservoir for holding liquid that passes through the porous stainless-steel particles.

2. The container of claim 1, wherein the contained liquid is a sanitizer.

3. The container of claim 1, wherein the container is a rigid container.

4. A liquid container for use in a liquid dispensing system, comprising:

a container body;

a fitting for the container body that is configured for connection to a one way valve through which a contained liquid may be controllably dispensed by a user; and a two way vent mounted to the container body which allows for ventilation of the contained liquid/gas in response to changes in air pressure outside of the liquid container;

wherein the two way vent comprises a stainless-steel body surrounding porous stainless-steel particles;

wherein the stainless steel body includes a head portion and a shaft portion with a central bore, wherein a first portion of the central bore is filled with said porous stainless-steel particles and wherein a second portion of the central bore is open to form a pressure differential compensating chamber;

wherein the shaft portion is threaded and wherein the container body includes a threaded opening configured to engage with the threaded shaft portion.

5. The container of claim 4, further comprising an o-ring positioned between a back of the head portion and an inner surface of the container body surrounding said threaded opening.

6. The container of claim 4, wherein the contained liquid is a sanitizer.

7. The container of claim 4, wherein the container is a rigid container.

8. A liquid container for use in a liquid dispensing system, comprising:

a container body;

a fitting for the container body that is configured for connection to a one way valve through which a contained liquid may be controllably dispensed by a user; and a two way vent mounted to the container body which allows for ventilation of the contained liquid/gas in response to changes in air pressure outside of the liquid container;

wherein the two way vent comprises a stainless-steel body surrounding porous stainless-steel particles;

wherein the stainless steel body includes a head portion and a shaft portion with a central bore, wherein a first portion of the central bore is filled with said porous stainless-steel particles and wherein a second portion of the central bore is open to form a pressure differential compensating chamber;

wherein the shaft portion is threaded and wherein the container body includes an opening through which the threaded shaft portion extends and wherein the two way vent further comprises a cap configured to threadingly engage with the threaded shaft portion.

9. The container of claim 8, further comprising an o-ring positioned between a back of the cap and an outer surface of the container body surrounding said opening.

10. The container of claim 8, wherein said cap includes a central bore including a first portion forming a first threaded opening configured to threadingly engage with the threaded shaft portion.

11. The container of claim 10, wherein said central bore further includes a second portion, having a smaller diameter than the first portion, forming a pressure differential compensating orifice.

12. The container of claim 11, wherein said central bore further includes a third portion, having a larger diameter than the second portion, forming a second threaded opening configured to threadingly engage with a plug for sealing the two way vent.

13. The container of claim 8, wherein the contained liquid is a sanitizer.

14. The container of claim 8, wherein the container is a rigid container.

15. A liquid dispensing system, comprising:

a one way dispensing valve;

a liquid container including a fitting for connecting to said one way dispensing valve; and a two way vent mounted to said liquid container, said two-way vent configured to allows for ventilation of a contained liquid/gas in response to changes in air pressure outside of the liquid container;

wherein the two way vent comprises a stainless-steel body including a head portion and a shaft portion, said stainless-steel body including a central bore wherein a first portion of the central bore is filled with porous stainless-steel particles, and wherein a wall of the liquid container includes an opening, and wherein said shaft portion extends through the opening and the stainless-steel body is secured to wall of the liquid container in order to seal the opening.

16. The system of claim 15, wherein the contained liquid is a sanitizer.

17. The system of claim 15, wherein the container is a rigid container.

18. The system of claim 15, further comprising an o-ring positioned between a back of the head portion and an inner surface of the liquid container surrounding said opening.

19. The system of claim 15, wherein the shaft portion is threaded wherein the two way vent further comprises a cap configured to threadingly engage with the threaded shaft portion.

20. The system of claim 19, further comprising an o-ring positioned between a back of the cap and an outer surface of the liquid container surrounding said opening.

* * * * *